US008907552B2

(12) United States Patent
Katsuraya et al.

(10) Patent No.: US 8,907,552 B2
(45) Date of Patent: Dec. 9, 2014

(54) HIGH-FREQUENCY PLASMA SPARK PLUG

(71) Applicant: NGK Spark Plug Co., Ltd., Nagoya-shi, Aichi-ken (JP)

(72) Inventors: Kohei Katsuraya, Nagoya (JP); Katsutoshi Nakayama, Shanghai (CN)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 14/353,699

(22) PCT Filed: Nov. 12, 2012

(86) PCT No.: PCT/JP2012/079209
§ 371 (c)(1), (2), (4) Date: Apr. 23, 2014

(87) PCT Pub. No.: WO2013/073487
PCT Pub. Date: May 23, 2013

(65) Prior Publication Data

US 2014/0292179 A1 Oct. 2, 2014

(30) Foreign Application Priority Data

Nov. 18, 2011 (JP) ..... 2011-252155

(51) Int. Cl.
*H01T 13/20* (2006.01)

(52) U.S. Cl.
CPC ..... *H01T 13/20* (2013.01)
USPC ..... 313/141; 313/118

(58) Field of Classification Search
CPC ..... H01T 13/39; H01T 13/32; H01T 13/34; H01T 13/02
USPC ..... 313/118–141
See application file for complete search history.

(56) References Cited

U.S. PATENT DOCUMENTS 5,977,695 A * 11/1999 Osamura et al. ..... 313/141
6,094,000 A * 7/2000 Osamura et al. ..... 313/141
6,528,929 B1 * 3/2003 Matsutani et al. ..... 313/141

(Continued)

FOREIGN PATENT DOCUMENTS

JP 2007-250257 A 9/2007
JP 2008-123989 A 5/2008
JP 2009-8100 A 1/2009

OTHER PUBLICATIONS

JPO/ISA, International Search Report in corresponding international application No. PCT/JP2012/079209 mailed Dec. 18, 2012.

*Primary Examiner* — Anne Hines
(74) *Attorney, Agent, or Firm* — Stites & Harbison PLLC; Jeffrey A. Haeberlin

(57) ABSTRACT

An ignition plug (1) includes a center electrode (5) extending in the direction of an axis (CL1), an insulator (2) having an axial hole (4) into which the center electrode (5) is inserted, a tip (31) joined to a forward end portion of the center electrode (5) by a fusion portion (35), and a ground electrode (27) forming a gap (33) in cooperation with the tip (31). The ignition plug generates high-frequency plasma at the gap (33) when high-frequency electric power is supplied to the gap (33). The forward end of the tip (31) is located forward of the forward end of the insulator (2) with respect to the direction of the axis (CL1). Also, at least a portion of the outer surface of the fusion portion (35) is located within the axial hole (4), and, the distance between a forward-end-side opening of the axial hole (4) and the rearmost end of the outer surface of the fusion portion (35), measured along the axis (CL1), is equal to or greater than 0.1 mm. Thus, in the ignition plug (1) which generates high-frequency plasma, corrosion of the fusion portion can be suppressed effectively, whereby durability is improved.

7 Claims, 8 Drawing Sheets

(56) References Cited

U.S. PATENT DOCUMENTS 7,652,413 B2 1/2010 Kawashima
2004/0129241 A1 7/2004 Freen
2007/0216276 A1 9/2007 Takada
2008/0093964 A1 4/2008 Kawashima

* cited by examiner

HIGH-FREQUENCY PLASMA SPARK PLUG

TECHNICAL FIELD

The present invention relates to a high-frequency plasma ignition plug which generates high-frequency plasma so as to ignite a fuel-air mixture or the like.

BACKGROUND ART

An ignition plug used for a combustion apparatus such as an internal combustion engine includes, for example, a center electrode extending in the axial direction, an insulator provided around the center electrode, a tubular metallic shell provided around the insulator, and a ground electrode having a base end portion joined to a forward end portion of the metallic shell. Through application of high voltage to the center electrode, spark discharge is produced at a gap formed between the center electrode and the ground electrode, whereby a fuel-air mixture is ignited.

In recent years, a technique for improving ignition performance has been proposed (see, for example, Patent Document 1, etc.). In the proposed technique, high-frequency electric power is supplied to the gap in place of high voltage so as to produce high-frequency plasma to thereby ignite a fuel-air mixture. Also, there has been proposed a technique of producing high-frequency plasma by supplying high-frequency electric power to spark generated through application of high voltage.

In addition, in order to enhance durability and/or ignition performance, a tip formed of a noble metal alloy or the like may be joined to a forward end portion of the center electrode. In general, such a tip is joined to the center electrode via a fusion portion which is formed by laser welding from the metal which forms the center electrode and the metal which forms the tip (see, for example, Patent Document 2, etc.).

PRIOR ART DOCUMENTS

Patent Documents

Patent Document 1: Japanese Patent Application Laid-Open (kokai) No. 2009-8100

Patent Document 2: Japanese Patent Application Laid-Open (kokai) No. 2008-123989

SUMMARY OF THE INVENTION

Problem to be Solved by the Invention

Incidentally, in general, the fusion portion is inferior in corrosion resistance to the tip. However, in the case of an ignition plug of a type in which a fuel-air mixture or the like is ignited by spark discharge, rapid corrosion of the fusion portion due to spark discharge hardly occurs. In contrast, in the case of an ignition plug of a type in which a fuel-air mixture or the like is ignited through generation of high-frequency plasma, the fusion portion may corrode rapidly as a result of generation of high-frequency plasma, which may result in coming off of the tip. Such rapid corrosion is considered to occur for the following reason. Namely, in the case of an ignition plug of a type in which ignition is performed by spark discharge, an initial flame is produced as a result of the spark discharge. In contrast, in the case of an ignition plug of a type in which ignition is performed by high-frequency plasma, high-frequency plasma which is much larger the initial flame and which is high in temperature is generated immediately after supply of electric power. Therefore, the high-frequency plasma is likely to come into contact with the fusion portion, which results in a considerable increase in the temperature of the fusion portion. As a result of this considerable temperature increase, the fusion portion corrodes rapidly.

The present invention has been accomplished in view of the above circumstances, and an object of the invention is to provide a high-frequency plasma ignition plug which can effectively suppress corrosion of a fusion portion to thereby prevent coming off of a tip more reliably.

Means for Solving the Problems

Configurations suitable for achieving the above object will next be described in itemized form. If needed, actions and effects peculiar to the configurations will be described additionally.

Configuration 1. A high-frequency plasma ignition plug of the present configuration comprises:

a center electrode extending in a direction of an axis;

an insulator having an axial hole into which the center electrode is inserted;

a tip joined to a forward end portion of the center electrode by a fusion portion which is a formed through fusion of the tip and the center electrode;

a tubular metallic shell provided around the insulator; and a ground electrode fixed to a forward end portion of the metallic shell and forming a gap in cooperation with the tip, the ignition plug being adapted to generate high-frequency plasma at the gap when high-frequency electric power is supplied to the gap, and being characterized in that a forward end of the tip is located forward of a forward end of the insulator with respect to the direction of the axis;

at least a portion of an outer surface of the fusion portion is located within the axial hole; and a distance between a forward-end-side opening of the axial hole and a rearmost end of the outer surface of the fusion portion, measured along the axis, is equal to or greater than 0.1 mm.

According to the above-described configuration 1, at least a portion of the outer surface of the fusion portion is located within the axial hole (namely, at least a portion of the fusion portion is located inside the insulator), and the distance between the forward-end-side opening of the axial hole and the rearmost end of the outer surface of the fusion portion, measured along the axis, is set to be equal to or greater than 0.1 mm. Accordingly, due to presence of the insulator, the high-frequency plasma generated at the gap becomes less likely to come into contact with the fusion portion, whereby an increase in the temperature of the fusion portion can be suppressed. As a result, corrosion of the fusion portion can be suppressed effectively, and coming off of the tip can be prevented more reliably.

Also, since the forward end of the tip is located forward of the forward end of the insulator with respect to the direction of the axis (namely, the gap is formed outside the axial hole), the high-frequency plasma expands without being hindered by the insulator, whereby satisfactory ignition performance can be realized. When the gap is located within the axial hole, a phenomenon (so-called channeling) in which the inner circumferential surface of the insulator is channeled as a result of supply of electric power occurs. However, according to the above-described configuration 1, such a phenomenon does not occur, and the durability of the insulator can be improved.

Configuration 2. A high-frequency plasma ignition plug of the present configuration is characterized in that, in the above-described configuration 1, a distance between an inner circumferential surface of the axial hole and a portion of the outer surface of the fusion portion located within the axial hole, measured along a direction orthogonal to the axis, is equal to or less than 0.3 mm.

According to the above-described configuration 2, the distance between the inner circumferential surface of the axial hole and a portion of the outer surface of the fusion portion located within the axial hole, measured along the direction orthogonal to the axis, (namely, the size of the gap formed between the outer surface of the fusion portion and the inner circumferential surface of the axial hole) is set to be equal to or less than 0.3 mm. Accordingly, invasion of high-frequency plasma into the gap can be prevented more reliably, whereby an increase in the temperature of the fusion portion can be suppressed effectively. As a result, corrosion of the fusion portion can be suppressed further, and coming off of the tip can be prevented further more reliably.

Configuration 3. A high-frequency plasma ignition plug of the present configuration is characterized in that, in the above-described configuration 1 or 2, the gap is formed between a forward end surface of the tip and a side surface of the ground electrode facing the forward end surface of the tip; and a shortest distance between the forward end of the tip and the outer surface of the fusion portion, measured along the axis, is equal to or greater than 0.8 mm.

According to the above-described configuration 3, the distance from the gap to the fusion portion can be made sufficiently large. Accordingly, it is possible to more reliably prevent the high-frequency plasma generated at the gap from coming into contact with the fusion portion, to thereby further suppress corrosion of the fusion portion.

Configuration 4. A high-frequency plasma ignition plug of the present configuration is characterized in that, in any of the above-described configurations 1 to 3, the center electrode has an outer layer and an inner layer provided inside the outer layer and formed of a metal higher in thermal conductivity than the outer layer; and a shortest distance between the fusion portion and the inner layer is equal to or less than 2.0 mm.

According to the above-described configuration 4, the heat of the fusion portion can be transferred to the center electrode (the inner layer) quickly, whereby overheating of the fusion portion caused by high-frequency plasma coming into contact therewith can be prevented more reliably. As a result, the effect of suppressing corrosion of the fusion portion can be enhanced further.

Configuration 5. A high-frequency plasma ignition plug of the present configuration is characterized in that, in any of the above-described configurations 1 to 4, the entire outer surface of the fusion portion is located within the axial hole.

According to the above-described configuration 5, contact of high-frequency plasma with the fusion portion can be prevented quite effectively, whereby an increase in the temperature of the fusion portion can be suppressed remarkably. As a result, the effect of suppressing corrosion of the fusion portion can be enhanced remarkably.

Configuration 6. A high-frequency plasma ignition plug of the present configuration is characterized in that, in any of the above-described configurations 1 to 5, the gap is formed between a forward end surface of the tip and a side surface of the ground electrode facing the forward end surface of the tip; and when the tip and the outer surface of the fusion portion are projected along the direction of the axis onto a plane orthogonal to the axis, a projection area of the outer surface is located within a projection area of the tip.

According to the above-described configuration 6, when viewed from the gap, the fusion portion is hidden by the tip. Therefore, high-frequency plasma becomes more unlikely to come into contact with the fusion portion, whereby the effect of suppressing corrosion of the fusion portion can be enhanced further.

Configuration 7. A high-frequency plasma ignition plug of the present configuration is characterized in that, in any of the above-described configurations 1 to 6, the gap is formed only between a forward end surface of the tip and a side surface of the ground electrode facing the forward end surface of the tip.

According to the above-described configuration 7, the gap is formed only at a position remote from the fusion portion. Accordingly, contact of high-frequency plasma with the fusion portion can be prevented more reliably, whereby corrosion of the fusion portion can be suppressed more effectively.

MODES FOR CARRYING OUT THE INVENTION

Figure 1:
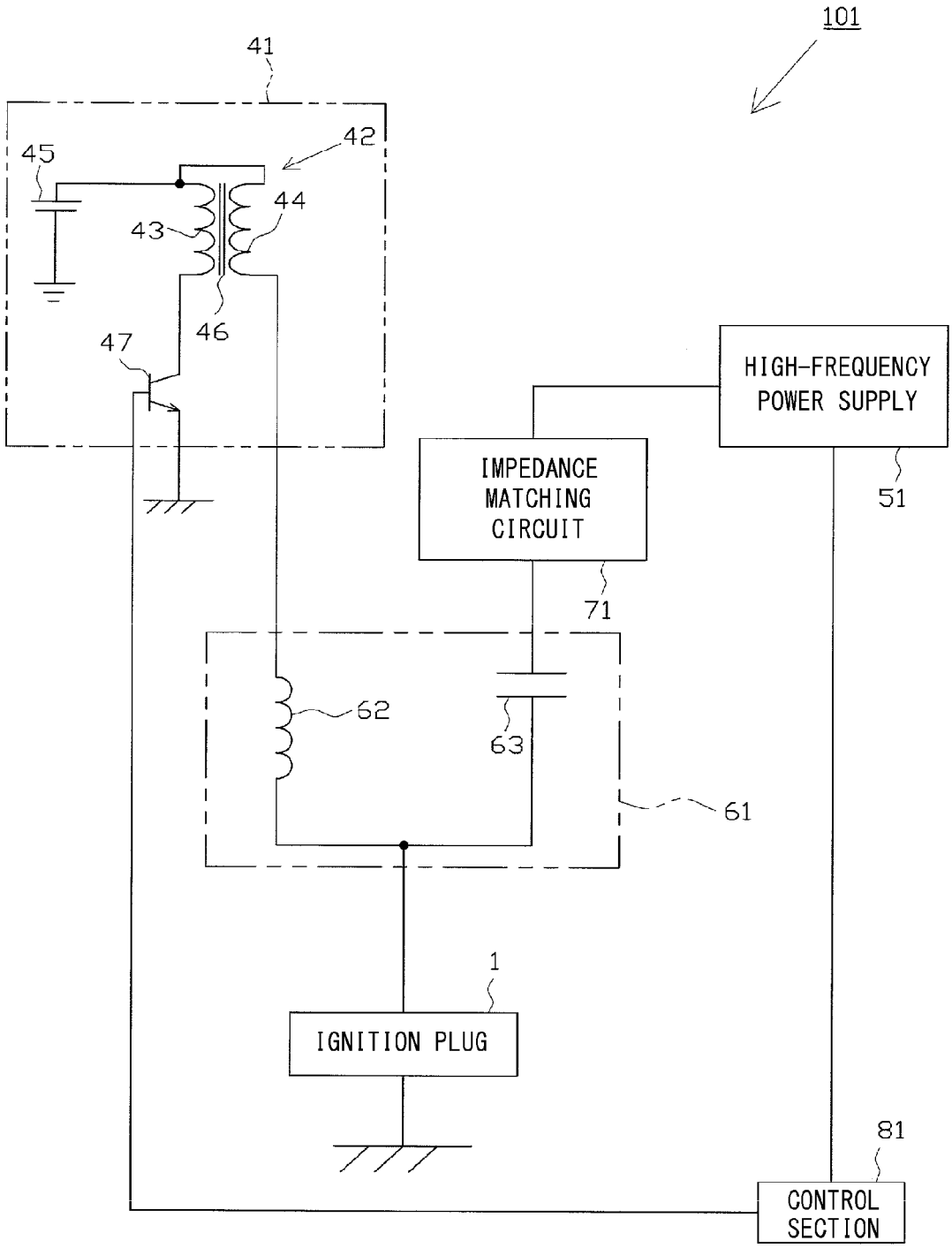
[FIG. 1] Block diagram schematically showing the configuration of an ignition system.

One embodiment will now be described with reference to the drawings. FIG. 1 is a block diagram schematically showing the configuration of an ignition system 101 which includes a high-frequency plasma ignition plug (hereinafter simply referred to as the "ignition plug") 1, a discharge power supply 41, a high-frequency power supply 51, and a mixing circuit 61. In FIG. 1, only one ignition plug 1 is illustrated. However, an actual combustion apparatus has a plurality of cylinders, and the ignition plug 1 is provided for each of the cylinders individually. Electric power from the discharge power supply 41 and the high-frequency power supply 51 is supplied to each ignition plug 1 through an unillustrated distributor. Notably, the discharge power supply 41 and the high-frequency power supply 51 may be provided for each of the ignition plugs 1 individually.

Before the description of the ignition plug 1, the discharge power supply 41, etc. will be first described.

The discharge power supply 41 applies high voltage to the ignition plug 1 so as to generate spark discharge at a gap 33 of the ignition plug 1 which will be described later. In the present embodiment, the discharge power supply 41 includes an ignition coil 42 whose secondary coil 44 is connected to the ignition plug 1 via a mixing circuit 61; a battery 45 for supplying electric power to the primary coil 43 of the ignition coil 42; a core 46 formed of a metal around which the primary coil 43 and the secondary coil 44 are wound; and an igniter 47 which permits and prohibits the supply of electric power to the primary coil 43. When a high voltage is to be applied to the ignition plug 1, the igniter 47 is turned on so as to supply a current from the battery 45 to the primary coil 43 to thereby form a magnetic field around the core 46, and the igniter 47 is then turned off so as to stop the supply of electricity from the battery 45 to the primary coil 43. As a result of stoppage of the supply of electricity, the magnetic field of the core 46 changes, and the secondary coil 44 generates a high voltage (e.g., 5 kV to 30 kV) of negative polarity. This high voltage is applied to the ignition plug 1, whereby spark discharge can be generated in the ignition plug 1 (the gap 33).

The high-frequency power supply 51 supplies electric power (AC power in the present embodiment) of a relatively high frequency (e.g., 50 kHz to 100 MHz) to the ignition plug 1. An impedance matching circuit (matching unit) 71 is provided between the high-frequency power supply 51 and the mixing circuit 61. The impedance matching circuit 71 is configured such that the output impedance of the high-frequency power supply 51 side matches the input impedance of the side where the mixing circuit 61 and the ignition plug 1 (load) are provided, whereby attenuation of the high-frequency power supplied to the ignition plug 1 is prevented. Notably, a high-frequency power transmission path from the high-frequency power supply 51 to the ignition plug 1 is formed by a coaxial cable which has an inner conductor and an outer conductor provided around the inner conductor. Thus, reflection of electric power is prevented.

The mixing circuit 61 allows both of the output power from the discharge power supply 41 and the output power from the high-frequency power supply 51 to be supplied to the ignition plug 1, while preventing current to flow between the discharge power supply 41 and the high-frequency power supply 51. The mixing circuit 61 includes a coil 62 and a capacitor 63. The coil 62 is connected to the output end of the discharge power supply 41. The current of a relatively low frequency output from the discharge power supply 41 can pass through the coil 62, and the current of a relatively high frequency output from the high-frequency power supply 51 cannot pass through the coil 62. The capacitor 63 is connected to the output terminal of the high-frequency power supply 51. The current of a relatively high frequency output from the high-frequency power supply 51 can pass through the capacitor 63, and the current of a relatively low frequency output from the discharge power supply 41 cannot pass through the capacitor 63. Notably, the secondary coil 44 may be used to provide the function of the coil 62. In such a case, the coil 62 can be omitted.

In the present embodiment, the electric power from the discharge power supply 41 and the high-frequency electric power from the high-frequency power supply 51 are supplied to the gap 33 through the electrode 8 (see FIG. 2) of the ignition plug 1. Thus, the high-frequency electric power from the high-frequency power supply 51 is supplied to the spark generated at the gap 33 as a result of supply of the electric power from the discharge power supply 41, whereby high-frequency plasma is generated. Namely, through the electrode 8, which serves as a common transmission path, the electric power from the discharge power supply 41 and the high-frequency electric power from the high-frequency power supply 51 are supplied to the gap 33, whereby the high-frequency electric power is directly supplied to the spark generated at the gap 33. Notably, in the present embodiment, the timings at which electric powers are supplied from the discharge power supply 41 and the high-frequency power supply 51 to the ignition plug 1, among others, are controlled by a control section 81 formed of a predetermined electronic control unit (ECU).

Next, the structure of the ignition plug 1 will be described.

Figure 2:
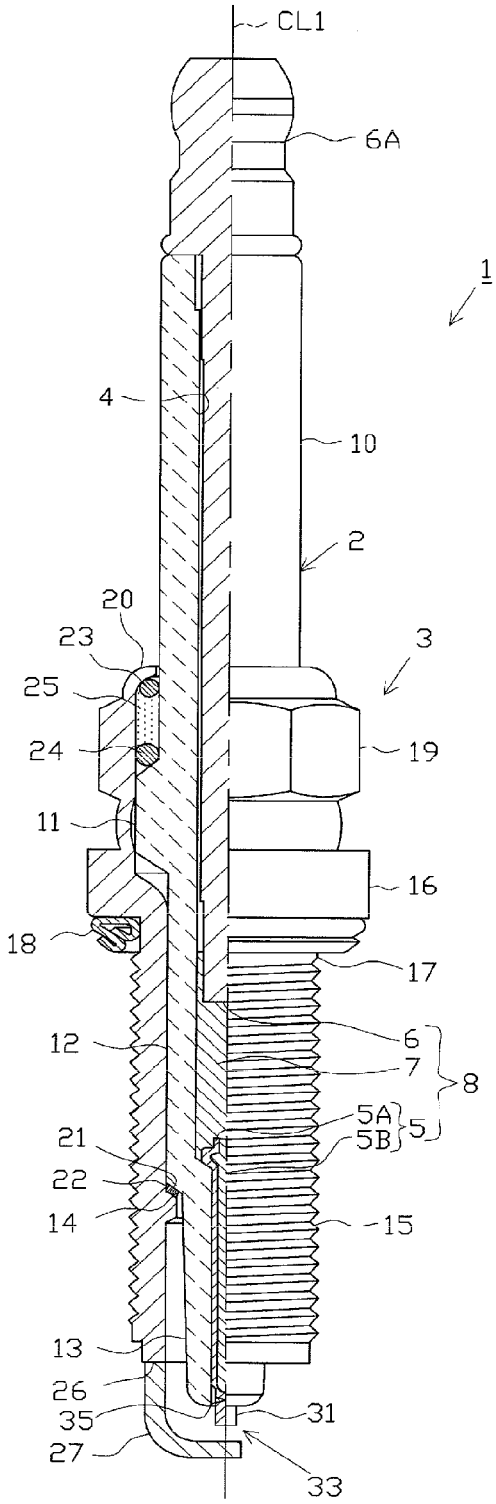
[FIG. 2] Partially cutaway front view showing the structure of an ignition plug.

As shown in FIG. 2, the ignition plug 1 includes a tubular ceramic insulator 2, which serves as an insulator, a tubular metallic shell 3 provided around the ceramic insulator 2, etc. Notably, in the following description, the direction of an axis CL1 of the ignition plug 1 in FIG. 2 is referred to as the vertical direction, and the lower side of FIG. 2 is referred to as the forward end side of the ignition plug 1, and the upper side as the rear end side of the ignition plug 1.

The ceramic insulator 2 is formed from alumina or the like by firing, as well known in the art. The ceramic insulator 2 includes a rear trunk portion 10, a large-diameter portion 11, an intermediate trunk portion 12, and a leg portion 13, which portions define the outward shape of the ceramic insulator 2. The rear trunk portion 10 is formed on the rear end side. The large-diameter portion 11 is located forward of the rear trunk portion 10 and projects radially outward. The intermediate trunk portion 12 is located forward of the large-diameter portion 11 and is smaller in diameter than the large-diameter portion 11. The leg portion 13 is located forward of the intermediate trunk portion 12 and is smaller in diameter than the intermediate trunk portion 12. Of the ceramic insulator 2, the large-diameter portion 11, the intermediate trunk portion 12, and the greater part of the leg portion 13 are accommodated in the metallic shell 3. A tapered, stepped portion 14 is formed at a connection portion between the intermediate trunk portion 12 and the leg portion 13. The ceramic insulator 2 is seated on the metallic shell 3 via the stepped portion 14.

The ceramic insulator 2 has an axial hole 4 extending therethrough along the axis CL1. An electrode 8 is fixedly inserted into the axial hole 4. The electrode 8 has a center electrode 5 provided in a forward end portion of the axial hole 4 and extending along the axis CL1, a terminal electrode 6 provided in a rear end portion of the axial hole 4, and a glass seal portion 7 provided between the electrodes 5 and 6.

The center electrode 5 has a rodlike shape as a whole, and its forward end projects from the forward end of the ceramic insulator 2 toward the forward end side with respect to the direction of the axis CL1. The center electrode 5 includes an outer layer 5A formed of an Ni alloy which contains nickel (Ni) as a main component, and an inner layer 5B provided inside the outer layer 5A and formed of a metal (e.g., copper, copper alloy, or pure Ni) which is higher in thermal conductivity than the metal used to form the outer layer 5A. Further. a tip 31 is joined to a forward end portion of the center electrode 5. The tip 31 is formed of a predetermined metal (e.g., a noble metal such as iridium or platinum, or a noble metal alloy which contains a noble metal as a main component). The tip 31 is joined to the center electrode 5 by a fusion portion 35 which is formed by laser welding and which contains the material of the tip 31 and the material of the center electrode 5 (outer layer 5A) in a mixed state. In the present embodiment, the tip 31 has the shape of a circular column having a fixed outer diameter along its axis. The outer diameter of the tip 31 is rendered equal to or smaller than that of the fusion portion 35.

The terminal electrode 6 is formed of a metal such as low-carbon steel, and has a rodlike shape as a whole. A connection portion 6A is provided at the rear end of the terminal electrode 6 such that the connection portion 6A projects from the rear end of the ceramic insulator 2. The output end of the mixing circuit 61 is electrically connected to the connection portion 6A.

The glass seal portion 7 is formed by sintering a mixture of metal powder, glass powder, etc. The glass seal portion 7 electrically connects the center electrode 5 and the terminal electrode 6 together, and fixes the two electrodes 5 and 6 to the ceramic insulator 2.

The metallic shell 3 is formed from a metal such as low-carbon steel into a tubular shape. The metallic shell 3 has a threaded portion (externally threaded portion) 15 on its outer circumferential surface. The threaded portion 15 is used to mount the ignition plug 1 to a mount hole of a combustion apparatus (e.g., an internal combustion engine, a fuel cell reformer, etc.). The metallic shell 3 has a seat portion 16 which is formed on the outer circumferential surface thereof to be located rearward of the threaded portion 15 and which projects radially outward. A ring-like gasket 18 is fitted to a screw neck 17 located at the rear end of the threaded portion 15. The metallic shell 3 also has a tool engagement portion 19 provided near its rear end. The tool engagement portion 19 has a hexagonal cross section and allows a tool such as a wrench to be engaged therewith when the metallic shell 3 is to be mounted to the combustion apparatus. Further, the metallic shell 3 has a crimp portion 20 provided at its rear end portion and adapted to hold the ceramic insulator 2.

Also, the metallic shell 3 has a tapered stepped portion 21 provided on the inner circumferential surface thereof and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end-side opening portion of the metallic shell 3 is crimped radially inward; i.e., the crimp portion 20 is formed, whereby the ceramic insulator 2 is fixed to the metallic shell 3. An annular sheet packing 22 is interposed between the stepped portions 14 and 21. This retains gastightness of a combustion chamber and prevents leakage of a fuel gas (a fuel-air mixture) to the exterior of the ignition plug 1 through the clearance between the inner circumferential surface of the metallic shell 3 and the leg portion 13 of the ceramic insulator 2, which is exposed to the interior of the combustion chamber.

In order to ensure gastightness which is established by crimping, annular ring members 23 and 24 intervene between the metallic shell 3 and the ceramic insulator 2 in a region near the rear end of the metallic shell 3, and the space between the ring members 23 and 24 is filled with powder of talc 25. That is, the metallic shell 3 holds the ceramic insulator 2 via the sheet packing 22, the ring members 23 and 24, and the talc 25.

Also, a ground electrode 27 is joined to a forward end portion 26 of the metallic shell 3. The ground electrode 27 is formed of an alloy which contains Ni as a main component, and is bent at its intermediate portion. A side surface of a distal end portion of the ground electrode 27 faces the forward end surface of the tip 31, and a gap 33 is formed between the forward end surface of the tip 31 and the side surface of the ground electrode 27. Notably, in the present invention, the ground electrode 27 is provided solely, and other ground electrodes are not provided, and the gap 33 is formed only between the forward end surface of the tip 31 and the side surface of the ground electrode 27 which faces the forward end surface.

Figure 3:
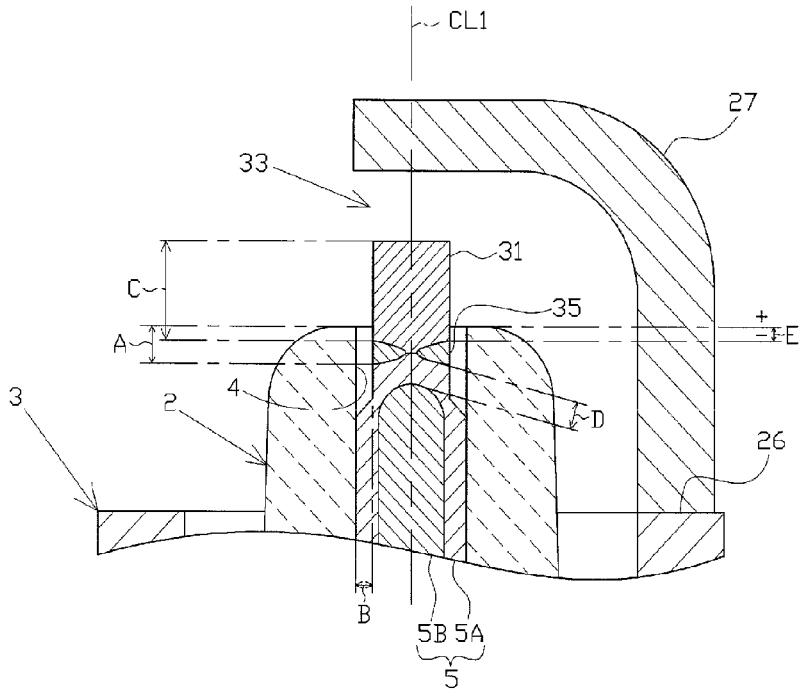
[FIG. 3] Enlarged sectional view showing the structure of a forward end portion of the ignition plug.

As shown in FIG. 3, the forward end of the tip 31 is located forward of the forward end of the ceramic insulator 2 with respect to the direction of the axis CL1 (is located outside the axial hole 4). Meanwhile, at least a portion of the outer surface of the fusion portion 35 which joins the tip 31 to the center electrode 5 is located within the axial hole 4. The distance A between the forward-end-side opening of the axial hole 4 and the rearmost end of the outer surface of the fusion portion 35, measured along the axis CL1, is set to 0.1 mm or greater.

Notably, in the present embodiment, the entire outer surface of the fusion portion 35 is located within the axial hole 4. Here, with the forward end of the ceramic insulator 2 being used as a reference, the forward end side thereof with respect to the direction of the axis CL1 is defined as a plus side, and the rear end side thereof with respect to the direction of the axis CL1 is defined as a minus side. When the distance between the forward end of the ceramic insulator 2 and the foremost end of the fusion portion 35, measured along the axis CL1, is represented by E (mm), the distance E is 0 or minus.

In addition, the distance B between the inner circumferential surface of the axial hole 4 and a portion of the outer circumferential surface of the fusion portion 35 located within the axial hole 4, as measured along a direction orthogonal to the axis CL1, is set to 0.3 mm or less.

Furthermore, in the present embodiment, the length of the tip 31 is rendered relatively large, and the shortest distance C between the forward end of the tip 31 and the outer surface of the fusion portion 35 along the axis CL1 is set to 0.8 mm or greater. Namely, the ignition plug 1 is configured such that the distance from the gap 33 to the outer surface of the fusion portion 35 becomes sufficiently large.

Also, in order to more quickly transfer the heat of the fusion portion 35 to the center electrode 5, the shortest distance D between the fusion portion 35 and the inner layer 5B is set to 2.0 mm or less.

As having been described in detail, according to the present embodiment, at least a portion of the outer surface of the fusion portion 35 is located within the axial hole 4, and the above-mentioned distance A is set to be equal to or grater than 0.1 mm. Accordingly, due to presence of the ceramic insulator 2, the high-frequency plasma generated at the gap 33 becomes less likely to come into contact with the fusion portion 35, and an increase in the temperature of the fusion portion 35 can be suppressed. As a result, corrosion of the fusion portion 35 can be suppressed effectively, and coming off of the tip 31 can be prevented more reliably. In particular, in the present embodiment, since the entire outer surface of the fusion portion 35 is located within the axial hole 4, contact of the high-frequency plasma with the fusion portion 35 can be prevented quite effectively, whereby the effect of suppressing corrosion of the fusion portion 35 can be enhanced remarkably.

Also, the forward end of the tip 31 is located forward of the forward end of the ceramic insulator 2 with respect to the direction of the axis CL1. Therefore, high-frequency plasma expands without being hindered by the ceramic insulator 2, whereby satisfactory ignition performance can be realized. Also, since occurrence of so-called channeling can be prevented, the durability of the ceramic insulator 2 can be improved.

Further, the above-described distance B (namely, the size of the gap formed between the outer surface of the fusion portion 35 and the inner circumferential surface of the axial hole 4) is set to be equal to or less than 0.3 mm. Accordingly, invasion of high-frequency plasma into the gap can be prevented more reliably, whereby an increase in the temperature of the fusion portion 35 can be suppressed effectively. As a result, corrosion of the fusion portion 35 can be suppressed further, and coming off of the tip 31 can be prevented more reliably.

In addition, since the above-mentioned shortest distance C is set to be equal to or greater than 0.8 mm, the distance from the gap 33 to the fusion portion 35 can be made sufficiently large. Accordingly, contact of high-frequency plasma with the fusion portion 35 can be prevented more reliably, whereby corrosion of the fusion portion 35 cab be suppressed further.

In addition, since the above-mentioned shortest distance is set to be equal to or less than 2.0 mm, the heat of the fusion portion 35 can be transferred to the center electrode 5 (the inner layer 5B) quickly, whereby overheating of the fusion portion 35 caused by high-frequency plasma coming into contact therewith can be prevented more reliably. As a result, the effect of suppressing corrosion of the fusion portion 35 can be enhanced to a greater degree.

Also, in the present embodiment, the gap 33 is formed only between the forward end surface of the tip 31 and the side surface of the ground electrode 27 facing the forward end surface. Namely, the gap 33 is formed only at a position remote from the fusion portion 35. Accordingly, contact of high-frequency plasma with the fusion portion 35 can be prevented more reliably, whereby corrosion of the fusion portion 35 can be suppressed more effectively.

Figure 4:
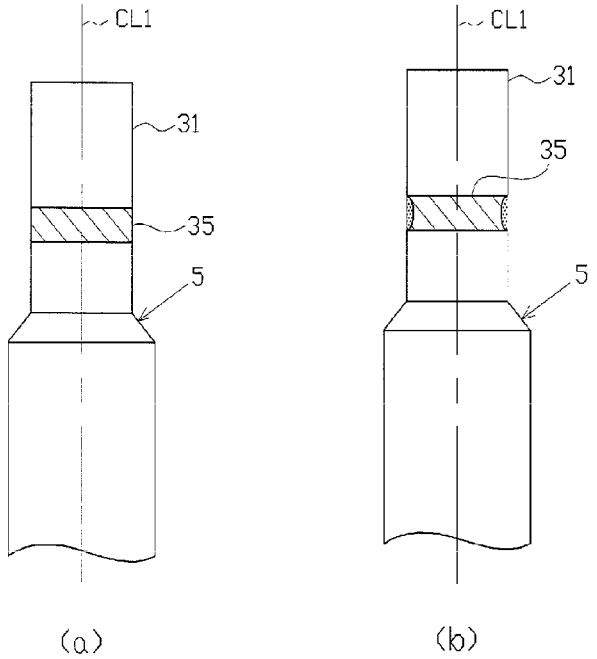
[FIGS. 4(*a*) and 4(*b*)] Enlarged side views of a fusion portion, etc. used for describing the area of corrosion.
Figure 5:
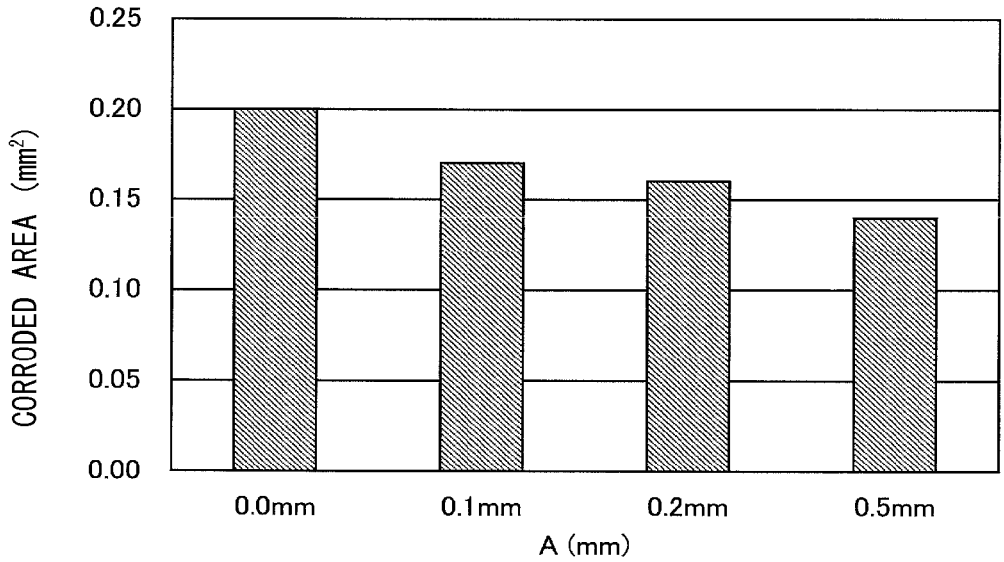
[FIG. 5] Graph showing the results of an on-bench durability test performed for samples which differed in distance A.

Next, in order to check the actions and effects achieved by the above-described embodiment, samples of the ignition plug in which the distance A (the distance between the forward-end-side opening of the axial hole and the rearmost end of the outer surface of the fusion portion along the axis) was set to 0.0 mm, 0.1 mm, 0.2 mm, or 0.5 mm were manufactured, and an on-bench durability test was carried out for each sample. The outline of the on-bench durability test is as follows. Namely, an ignition plug was attached to a predetermined chamber, and the pressure within the chamber was set to 0.4 MPa. In this state, a voltage was applied to the ignition plug so as to generate high-frequency plasma, with the frequency of the applied voltage set to 20 Hz (i.e., at a rate of 1200 times per min). After elapse of 20 hours, the fusion portion was photographed by a camera from the side toward the side surface of the center electrode as shown in FIGS. 4(*a*) and 4(*b*). The area of the fusion portion (a hatched portion in FIG. 4(*a*)) as viewed from the side toward the side surface of the center electrode before the test was determined on the basis of the image of the fusion portion captured before the test. Also, the area of the fusion portion (a hatched portion in FIG. 4(*b*)) as viewed from the side toward the side surface of the center electrode after the test was determined on the basis of the image of the fusion portion captured after the test. A decrease in area (corroded area (the area of dotted portions in FIG. 4(*b*)) of the fusion portion was measured from the area of the fusion portion before the test and the area of the fusion portion after the test. FIG. 5 shows the results of the test.

Notably, in the test, the output power of the high-frequency power supply was set to 600 W, and the output frequency thereof was set to 13 MHz. Also, the tip was formed of an iridium alloy, and its outer diameter was set to 1.5 mm (notably, the output power, the output frequency, the material of the tip, and its diameter were the same in tests which will be described below). Further, the length of the tip was set to 0.9 mm, the inner diameter of the forward-end-side opening of the axial hole was set to 2.3 mm, and the length of the outer surface of the fusion portion along the axis was set to 0.6 mm. Moreover, the above-mentioned distance B was set to 0.4 mm. Notably, the corroded area can also be measured through use of a projector or the like.

As shown in FIG. 5, it was found that each of the samples in which the distance A is set to 0.1 mm or greater has a decreased corroded area of to 0.20 $mm^2$ or less and can suppress corrosion of the fusion portion effectively. Conceivably, the corroded area decreased because high-frequency plasma became less likely to come into contact with the fusion portion, and an increase in the temperature of fusion portion caused by high-frequency plasma coming into contact with the fusion portion was suppressed.

The above-described test results demonstrate that, from the viewpoint of suppressing corrosion of the fusion portion and preventing coming off of the tip, the distance between the forward-end-side opening of the axial hole and the rearmost end of the outer surface of the fusion portion along the axis is preferably set to 0.1 mm or greater.

Figure 6:
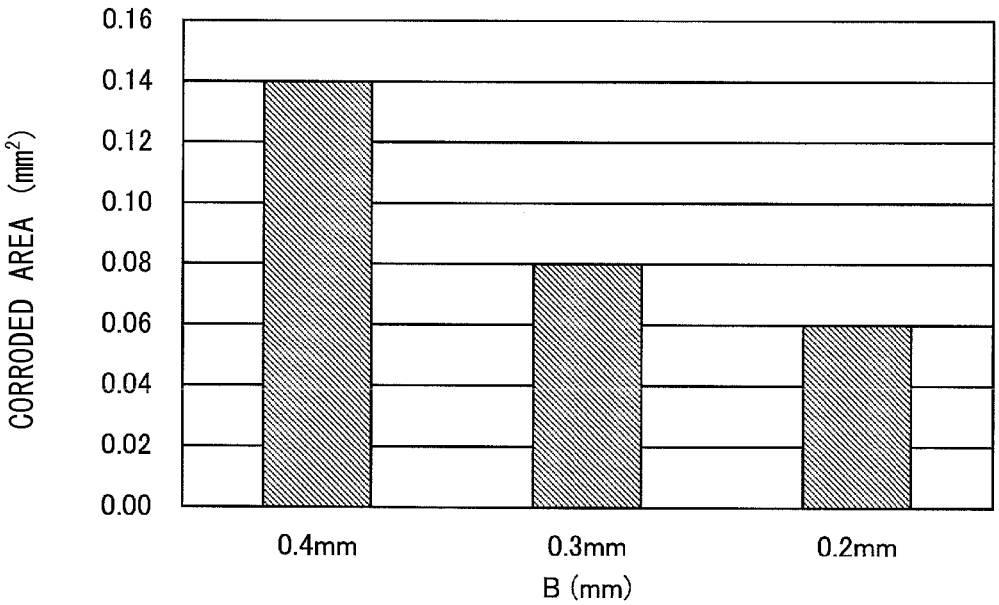
[FIG. 6] Graph showing the results of an on-bench durability test performed for samples which differed in distance B.

Next, samples of the ignition plug in which the distance B (the distance between the inner circumferential surface of the axial hole and a portion of the outer surface of the fusion portion located within the axial hole as measured in the direction orthogonal to the axis) was set to 0.2 mm, 0.3 mm, or 0.4 mm were manufactured, and the above-described on-bench durability test was carried out. FIG. 6 shows the results of this test. Notably, in each sample, the distance A was set to 0.5 mm.

As shown in FIG. 6, it was found that each of the samples in which the distance B is set to 0.3 mm or less has a greatly decreased corroded area, and has an excellent effect of suppressing corrosion of the fusion portion. Conceivably, this great decrease occurred because the high-frequency plasma become less likely to enter the gap between the inner circumferential surface of the ceramic insulator and the fusion portion, whereby an increase in the temperature of the fusion portion was suppressed effectively.

The above-described test results demonstrate that the distance between the inner circumferential surface of the axial hole and the portion of the outer surface of the fusion portion located within the axial hole as measured in the direction orthogonal to the axis is preferably set to 0.3 mm or less in order to further suppress corrosion of the fusion portion.

Figure 7:
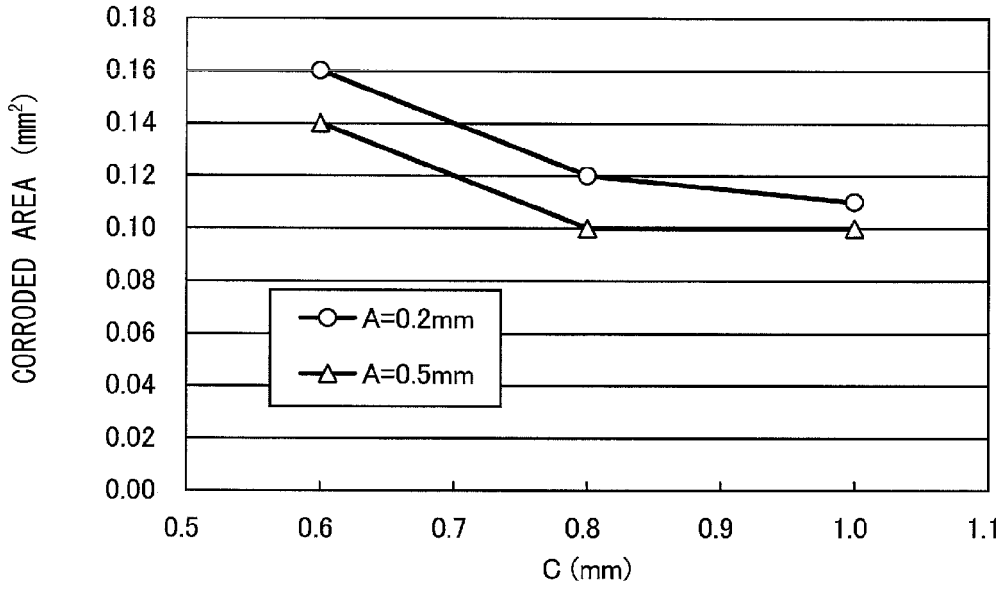
[FIG. 7] Graph showing the results of an on-bench durability test performed for samples which differed in distance C.

Next, samples of the ignition plug in which the distance A was set to 0.2 mm or 0.5 mm and the shortest distance C between the forward end of the tip and the outer surface of the fusion portion along the axis was set to 0.6 mm, 0.8 mm, or 1.0 mm through use of tips having different lengths were manufactured, and the above-described on-bench durability test was carried out. FIG. 7 shows the results of this test. Notably, in FIG. 7, the test results of the samples in which the distance A was set to 0.2 mm are indicated by circular marks, and the test results of the samples in which the distance A was set to 0.5 mm are indicated by triangular marks. Also, in each sample, the distance B was set to 0.3 mm.

As shown in FIG. 7, it was found that the samples in which the shortest distance C is set to 0.8 mm or greater are more excellent in the effect of suppressing corrosion of the fusion portion. Conceivably, the more excellent effect was obtained because high-frequency plasma became less likely to come into contact with the fusion portion due to a sufficiently increased distance from the position (gap) of generation of the high-frequency plasma to the fusion portion.

The above-described test results demonstrate that the shortest distance between the forward end of the tip and the outer surface of the fusion portion along the axis is preferably set to 0.8 mm or greater in order to further enhance the effect of suppressing corrosion of the fusion portion.

Figure 8:
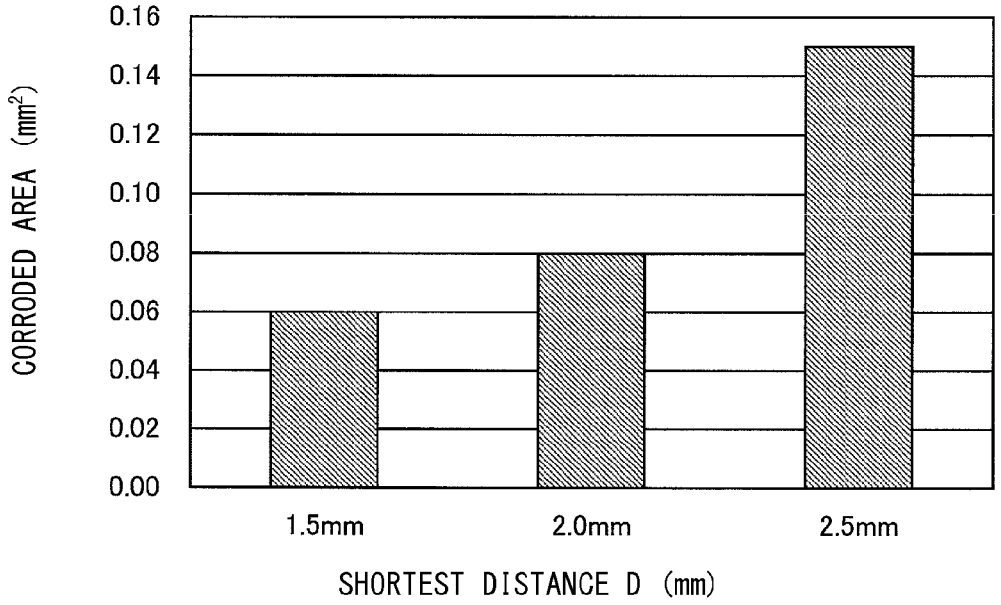
[FIG. 8] Graph showing the results of an on-bench durability test performed for samples which differed in distance D.

Next, samples of the ignition plug in which the shortest distance D between the fusion portion and the inner layer was changed among various values were manufactured, and the above-described on-bench durability test was carried out. FIG. 8 shows the results of this test. Notably, in each sample, the distance A was set to 0.5 mm, the distance B was set to 0.3 mm, and the shortest distance C was set to 0.7 mm.

As shown in FIG. 8, it was confirmed that each of the samples in which the shortest distance D is set to 2.0 mm or less has a remarkably decreased corroded area and is extremely excellent in the effect of suppressing corrosion of the fusion portion. Conceivably, the corroded area decreased remarkably because the decreased distance between the fusion portion and the inner layer allowed quick transfer of the heat of the fusion portion to the center electrode (the inner layer) to thereby further lower the temperature of the fusion portion.

The above-described test results demonstrate that the shortest distance between the fusion portion and the inner layer is preferably set to 2.0 mm or less in order to more reliably lower the temperature of the fusion portion and further suppress corrosion of the fusion portion.

Figure 9:
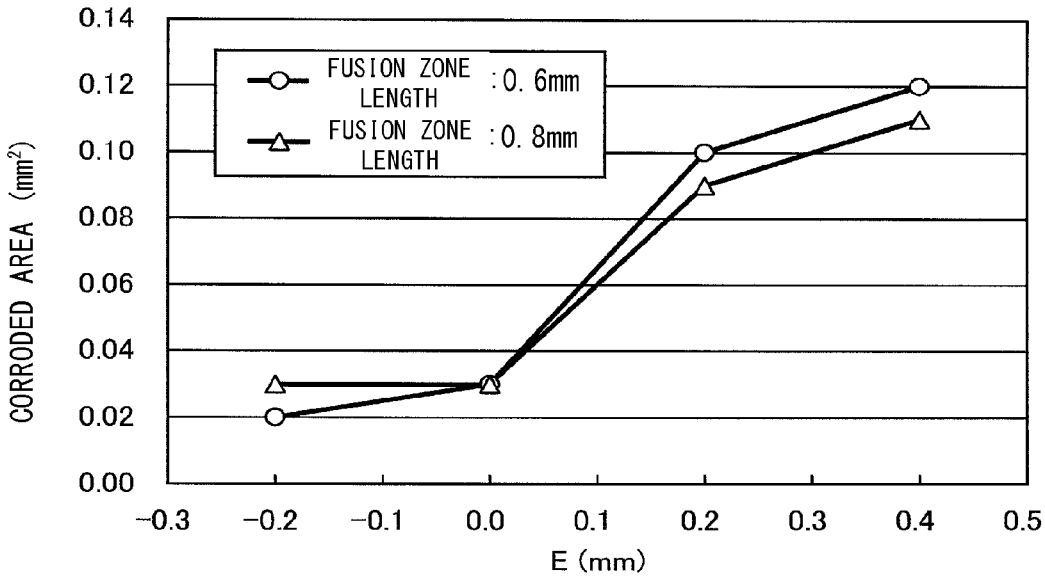
[FIG. 9] Graph showing the results of an on-bench durability test performed for samples which differed in distance E.

Next, there were manufactured samples of the ignition plug in which the length of the outer surface of the fusion portion along the axis (the length of the fusion portion) was set to 0.6 mm or 0.8 mm and the distance E (the distance from the forward end of the ceramic insulator to the foremost end of the fusion portion along the axis, with the forward end side of the forward end (reference) of the ceramic insulator with respect to the direction of the axis being defined as the plus side and the rearward end side thereof with respect to the direction of the axis being defined as the minus side) was set among various values. The above-described on-bench durability test was carried out by using these samples. FIG. 9 shows the results of this test. Notably, in FIG. 9, the test results of the samples in which the fusion portion length was set to 0.6 mm are indicated by circular marks, and the test results of the samples in which the fusion portion length was set to 0.8 mm are indicated by triangular marks. Also, in FIG. 9, a region in which the distance E is plus indicates that at least a portion of the fusion portion is located outside the axial hole, and a region in which the distance E is zero or minus indicates that the entire fusion portion is located within the axial hole. Notably, in each sample, the distance B was set to 0.3 mm, and the shortest distance C was set to 0.7 mm.

As shown in FIG. 9, it was found that when the distance E is set to become 0.0 mm or minus; i.e., when the entire outer surface of the fusion portion is disposed within the axial hole, the effect of suppressing corrosion of the fusion portion is enhanced remarkably. Conceivably, this remarkable enhancement of the effect was achieved because the contact of high-frequency plasma to the fusion portion was suppressed quite effectively.

The above-described test results demonstrate that the entire outer surface of the fusion portion is preferably disposed within the axial hole in order to suppress corrosion of the fusion portion further more reliably.

Notably, the present invention is not limited to the above-described embodiment, but may be embodied, for example, as follows. Of course, applications and modifications other than those described below are also possible.

Figure 10:
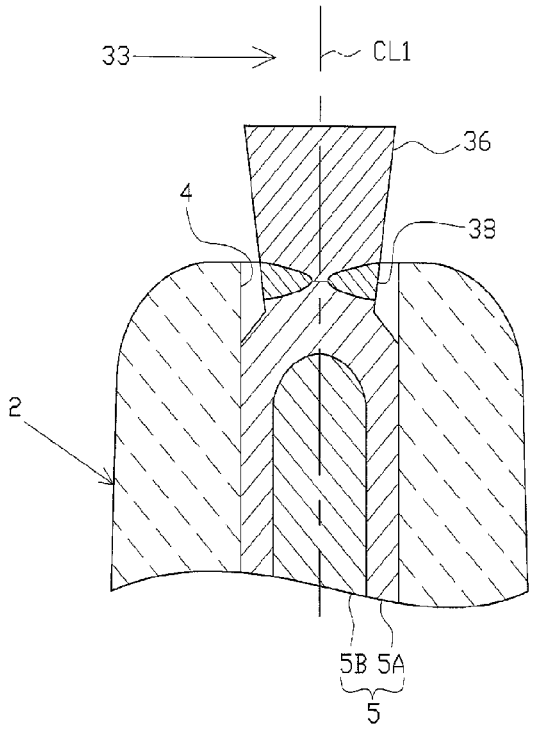
[FIG. 10] Enlarged sectional view showing the structure of a tip, etc. in another embodiment.
Figure 11:
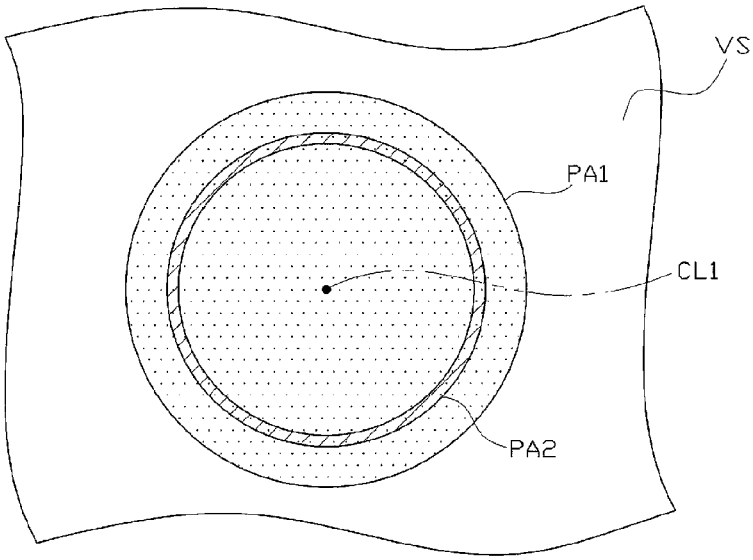
[FIG. 11] Projection view showing a projection area of the tip and a projection area of the outer surface of the fusion portion obtained by projecting the tip and the outer surface of the fusion portion onto a plane orthogonal to the axis.
Figure 12:
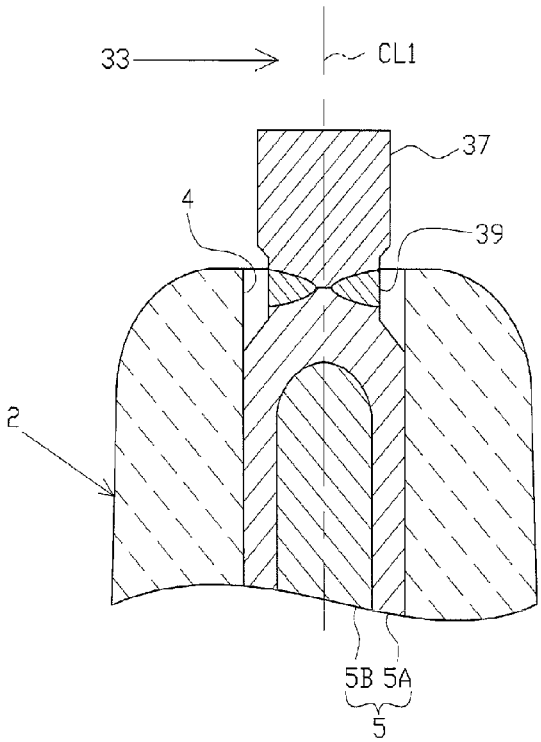
[FIG. 12] Enlarged sectional view showing the structure of a tip, etc. in another embodiment.

(a) In the above-described embodiment, the tip 31 has a circular columnar shape, and its outer diameter is made equal to or smaller than the outer diameter of the fusion portion 35. However, the configuration shown FIG. 10 may be employed. In this configuration, the outer diameter of at least a portion of a tip 36 is made greater than the outer diameter of a fusion portion 38 by, for example, forming the tip 36 such that the outer diameter of the tip 36 increases gradually toward the forward end side with respect to the direction of the axis CL1. Namely, the tip 36 may be configured such that when the tip 36 and the outer surface of the fusion portion 38 are projected along the axis CL1 onto a plane VS orthogonal to the axis CL1 as shown in FIG. 11, a projection area PA2 (a hatched portion in FIG. 11) of the outer surface of the fusion portion 38 is located in a projection area PA1 (a dotted portion in FIG. 11) of the tip 36. In this case, when viewed from the gap 33, the fusion portion 38 is hidden by the tip 36. Therefore, high-frequency plasma becomes more unlikely to come into contact with the fusion portion 38, whereby the effect of suppressing corrosion of the fusion portion 38 can be enhanced further. Notably, the configuration shown in FIG. 12 may be employed. In this configuration, the outer diameter of at least a portion of a tip 37 is made greater than the outer diameter of a fusion portion 39 by reducing the diameters of a forward end portion of the center electrode 5 and a rear end portion of the tip 37, at which the fusion portion 39 is formed.

Figure 13:
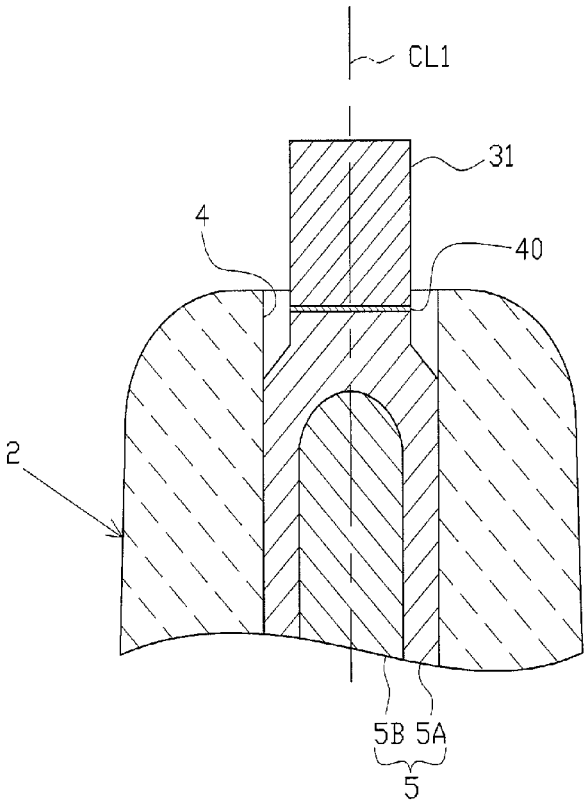
[FIG. 13] Enlarged sectional view showing a fusion portion in another embodiment.

(b) In the above-described embodiment, the tip 31 is joined to the center electrode 5 by the fusion portion 35 formed through laser welding. In contrast, as shown in FIG. 13 (notably, in FIG. 13, a fusion portion 40 is shown to have a thickness greater than the actual thickness in order to facilitate the depiction thereof), the tip 31 may be joined to the center electrode 5 by a fusion portion 40 formed through resistance welding. In this case, the volume of the fusion portion 40 can be decreased, and the area of its outer surface can be reduced considerably. As a result, an increase in the temperature of the fusion portion 40 caused by high-frequency plasma coming into contact with the fusion portion 40 can be suppressed to a greater degree, whereby the effect of suppressing corrosion of the fusion portion 40 can be enhanced to a greater degree. Notably, from the viewpoint of joint strength, it is preferred to join the tip 31 to the center electrode 5 by means of laser welding.

(c) In the above-described embodiments, the ground electrode 27 is joined to the forward end portion 26 of the metallic shell 3. However, the present invention can be applied to the case where the ground electrode is formed, through cutting operation, from a portion of the metallic shell (or a portion of a forward end metal piece welded to the metallic shell in advance) (see, for example, Japanese Patent Application Laid-Open (kokai) No. 2006-236906).

(d) In the above-described embodiments, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF SYMBOLS

1: ignition plug (high-frequency plasma ignition plug)
2: ceramic insulator (insulator)
3: metallic shell
4: axial hole
5: center electrode
5A: outer layer
5B: inner layer
27: ground electrode
31: tip
33: gap
35: fusion portion CL1: axis
PA1: projection area (of the tip)
PA2: projection area (of the outer surface of the fusion portion)
VS: plane

What is claimed is:

1. A high-frequency plasma ignition plug comprising:
a center electrode extending in a direction of an axis;
an insulator having an axial hole into which the center electrode is inserted;
a tip joined to a forward end portion of the center electrode by a fusion portion which is a formed through fusion of the tip and the center electrode;
a tubular metallic shell provided around the insulator; and
a ground electrode fixed to a forward end portion of the metallic shell and forming a gap in cooperation with the tip,
the ignition plug being adapted to generate high-frequency plasma at the gap when high-frequency electric power is supplied to the gap, and being characterized in that
a forward end of the tip is located forward of a forward end of the insulator with respect to the direction of the axis;
at least a portion of an outer surface of the fusion portion is located within the axial hole; and
a distance between a forward-end-side opening of the axial hole and a rearmost end of the outer surface of the fusion portion, measured along the axis, is equal to or greater than 0.1 mm.

2. A high-frequency plasma ignition plug according to claim 1, wherein a distance between an inner circumferential surface of the axial hole and a portion of the outer surface of the fusion portion located within the axial hole, measured along a direction orthogonal to the axis, is equal to or less than 0.3 mm.

3. A high-frequency plasma ignition plug according to claim 1, wherein
the gap is formed between a forward end surface of the tip and a side surface of the ground electrode facing the forward end surface of the tip; and
a shortest distance between the forward end of the tip and the outer surface of the fusion portion, measured along the axis, is equal to or greater than 0.8 mm.

4. A high-frequency plasma ignition plug according to claim 1, wherein
the center electrode has an outer layer and an inner layer provided inside the outer layer and formed of a metal higher in thermal conductivity than the outer layer; and
a shortest distance between the fusion portion and the inner layer is equal to or less than 2.0 mm.

5. A high-frequency plasma ignition plug according to claim 1, wherein the entire outer surface of the fusion portion is located within the axial hole.

6. A high-frequency plasma ignition plug according to claim 1, wherein
the gap is formed between a forward end surface of the tip and a side surface of the ground electrode facing the forward end surface of the tip; and
when the tip and the outer surface of the fusion portion are projected along the direction of the axis onto a plane orthogonal to the axis, a projection area of the outer surface is located within a projection area of the tip.

7. A high-frequency plasma ignition plug according to claim 1, wherein
the gap is formed only between a forward end surface of the tip and a side surface of the ground electrode facing the forward end surface of the tip.

* * * * *